US006182956B1

(12) United States Patent
McMillan

(10) Patent No.: US 6,182,956 B1
(45) Date of Patent: Feb. 6, 2001

(54) VACUUM TABLE WITH MAT

(76) Inventor: Timothy A. McMillan, 105 Astro Dr., Morgantown, NC (US) 28655

( * ) Notice: Under 35 U.S.C. 154(b), the term of this patent shall be extended for 0 days.

(21) Appl. No.: 09/283,243

(22) Filed: Apr. 1, 1999

Related U.S. Application Data

(60) Provisional application No. 60/094,662, filed on Jul. 30, 1998.

(51) Int. Cl.[7] ..... B25B 11/00
(52) U.S. Cl. ..... 269/21
(58) Field of Search ..... 269/21; 451/388; 279/3; 294/64.1

(56) References Cited

U.S. PATENT DOCUMENTS

| | | | | |
|---|---|---|---|---|
| 3,598,006 | * | 8/1971 | Gerber et al. | 269/21 |
| 4,205,835 | | 6/1980 | Gerber . | |
| 4,301,999 | | 11/1981 | Higgins et al. . | |
| 4,656,906 | * | 4/1987 | Mozieka et al. | 269/21 |
| 5,374,021 | | 12/1994 | Kleinman . | |
| 5,486,932 | | 1/1996 | Leonard . | |
| 5,504,301 | | 4/1996 | Eveland . | |
| 5,685,513 | | 11/1997 | Tsukushi . | |
| 5,695,600 | | 12/1997 | Goin . | |

FOREIGN PATENT DOCUMENTS

| | | |
|---|---|---|
| 0265648 | 5/1988 | (EP) . |
| 0505668 | 9/1992 | (EP) . |
| 0603430 | 6/1994 | (EP) . |

* cited by examiner

*Primary Examiner*—Robert C. Watson
(74) *Attorney, Agent, or Firm*—Richard C. Litman

(57) ABSTRACT

A vacuum table and mat system having a removable and replaceable mat which retains workpieces via vacuum created suction. The mat has a base sheet with a plurality of perforations and channels therein, and a flexible rubber sheet atop the base sheet. Vacuum is applied to retain a workpiece via suction-cup like indentations formed when the rubber sheet is pulled into the perforations of the base sheet.

19 Claims, 11 Drawing Sheets

VACUUM TABLE WITH MAT

CROSS-REFERENCE TO RELATED APPLICATION

This application claims the benefit of U.S. Provisional Patent Application Serial No. 60/094,662, filed Jul. 30, 1998.

BACKGROUND OF THE INVENTION

1. Field of the Invention

The present invention relates generally to vacuum tables. More specifically, the invention is a vacuum table for securing a removably attached matting.

2. Description of Related Art

Vacuum tables have been used in the engraving and manufacturing industries for many years. Often, the table is damaged during engraving, milling, drilling, or other applications. This necessitates either costly repair or repurchase of a vacuum table, and adds to machine down time. A vacuum table with a removable and replaceable mat would therefore be beneficial.

Understandably, vacuum tables and related devices have been the subject of previous patents. U.S. Pat. No. 5,374,021, issued to Kleinman on Dec. 20, 1994, discloses a vacuum holder particularly useful as a vacuum table. The device includes a vacuum chamber divided into a plurality of sub-chambers which ultimately lead to a plurality of suction opening which extend through an outer holding surface for applying suction to a workpiece. U.S. Pat. No. 4,301,999, issued to Higgins et al. on Nov. 24, 1981, discloses a vacuum hold-down table for working with sheet metal. The table includes a plurality of foam layers united to form a laminated core having a plurality of apertures such that a vacuum may be applied through these apertures for holding sheet metal in place. U.S. Pat. No. 4,205,835, issued to Gerber on Jun. 3, 1980, discloses a bristle bed for a vacuum table. The bristle board includes aperture in the base that provide passageways for airflow through a mat in communication with a vacuum source.

Document scanners and copiers have benefitted from the use of vacuum tables for holding papers in place. U.S. Pat. No. 5,486,932, issued to Leonard on Jan. 23, 1996, and its European counterpart, EPO patent document 0,603,430 published Jun. 29, 1994, disclose a document scanner and vacuum table therefor. The table uses an array of openings to exert suction pressure generated by a vacuum on an object above to hold the object in place.

Vacuum tables have also been developed for other tasks, such as decal welding and laser engraving. U.S. Pat. No. 5,695,600, issued to Goin on Dec. 9, 1997, and U.S. Pat. No. 5,504,301, issued to Eveland on Apr. 2, 1996, are respective examples thereof.

Other devices using the power of vacuum have also been the subject of previous patents. Among them are: U.S. Pat. No. 5,685,513 (vacuum-suction attachment pad) issued to Tsukushi on Nov. 11, 1997; EPO document 0,265,648, published on May 4, 1988; and EPO document 0,505,668, published on Sep. 30, 1992.

Although many vacuum table designs exist, a system using a replaceable mat in a vacuum table which retains workpieces with a suction-cup like grip would be both useful and beneficial for various applications.

None of the above inventions and patents, taken either singly or in combination, is seen to describe the instant invention as claimed.

SUMMARY OF THE INVENTION

A vacuum table according to the present invention includes a vacuum plate, a mat, and a vacuum system. The vacuum plate forms a base for the unit and is provided with an aperture through which air is pulled by a vacuum pump. The mat rests on the vacuum plate and is sealed therewith by a gasket. A base sheet of the mat is provided with a plurality of perforations which are connected on the underside of the base sheet by a network of channels. The channels allow for even pull of air from under the mat through to the vacuum pump. A rubber sheet is affixed to the upper surface of the base sheet. A plurality of small holes are defined by the rubber sheet corresponding to the perforation of the base sheet. A vacuum pull beneath the mat forces the rubber sheet to cave in at each perforation of the base sheet, thereby creating a plurality of suction-cup like indentations on the upper surface which ultimately hold a workpiece in place.

Accordingly, it is a principal object of the invention to secure a workpiece to a work surface via vacuum pressure.

It is another object of the invention to secure a work piece to a work surface via vacuum pressure exerted below a mat causing the mat perform in a suction-cup like manner.

It is a further object of the invention to facilitate ease of repair of a vacuum table.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a vacuum table especially useful in holding a workpiece to a surface for engraving or other purposes. Referring to the Figures, the table 50 is made up of a vacuum plate 10, a replaceable mat 52 on which work items may be held, and a vacuum assembly 54.

Figure 1:
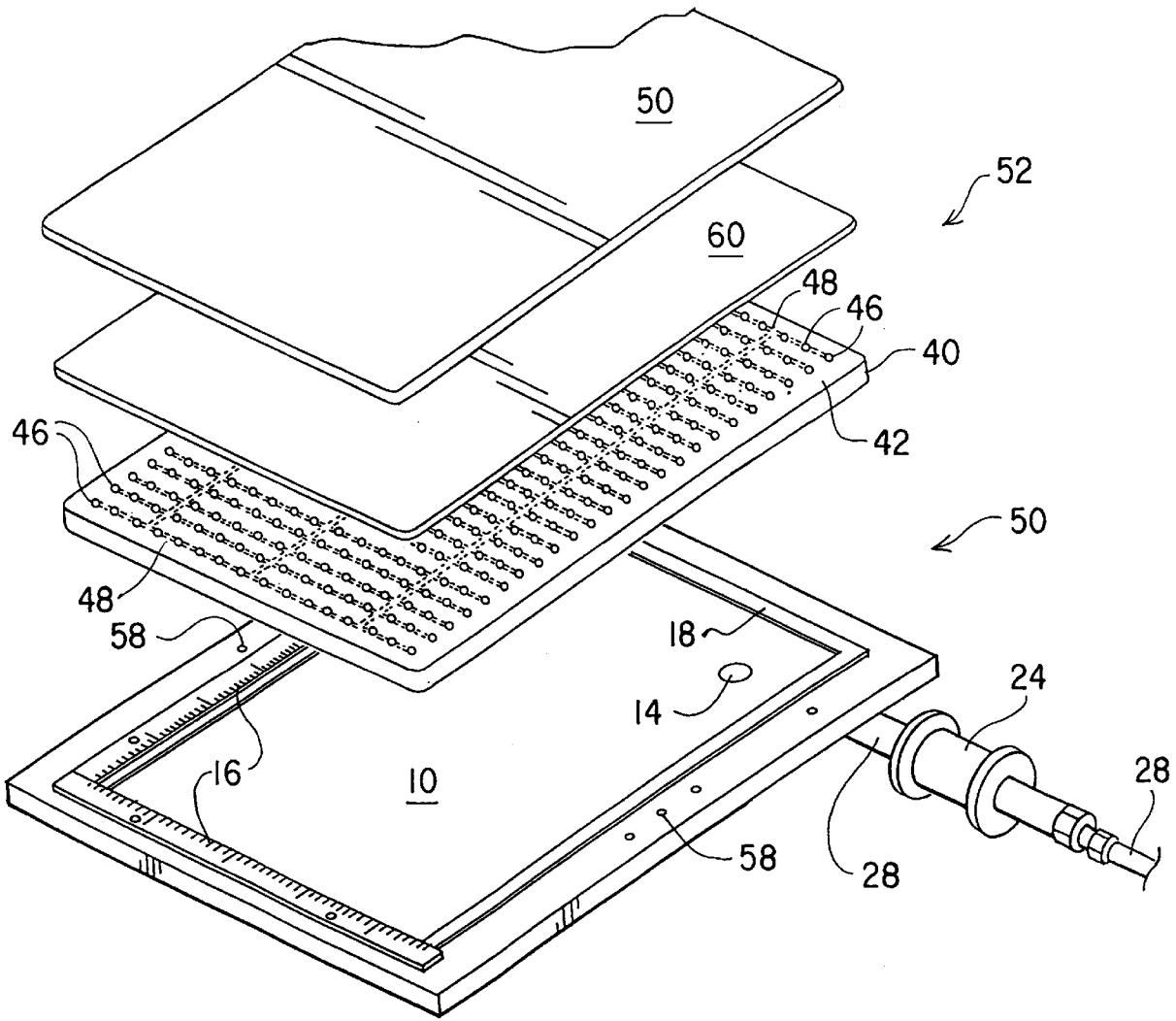
FIG. 1 is a perspective view of a first embodiment of a vacuum table and mat according to the present invention.
Figure 7:
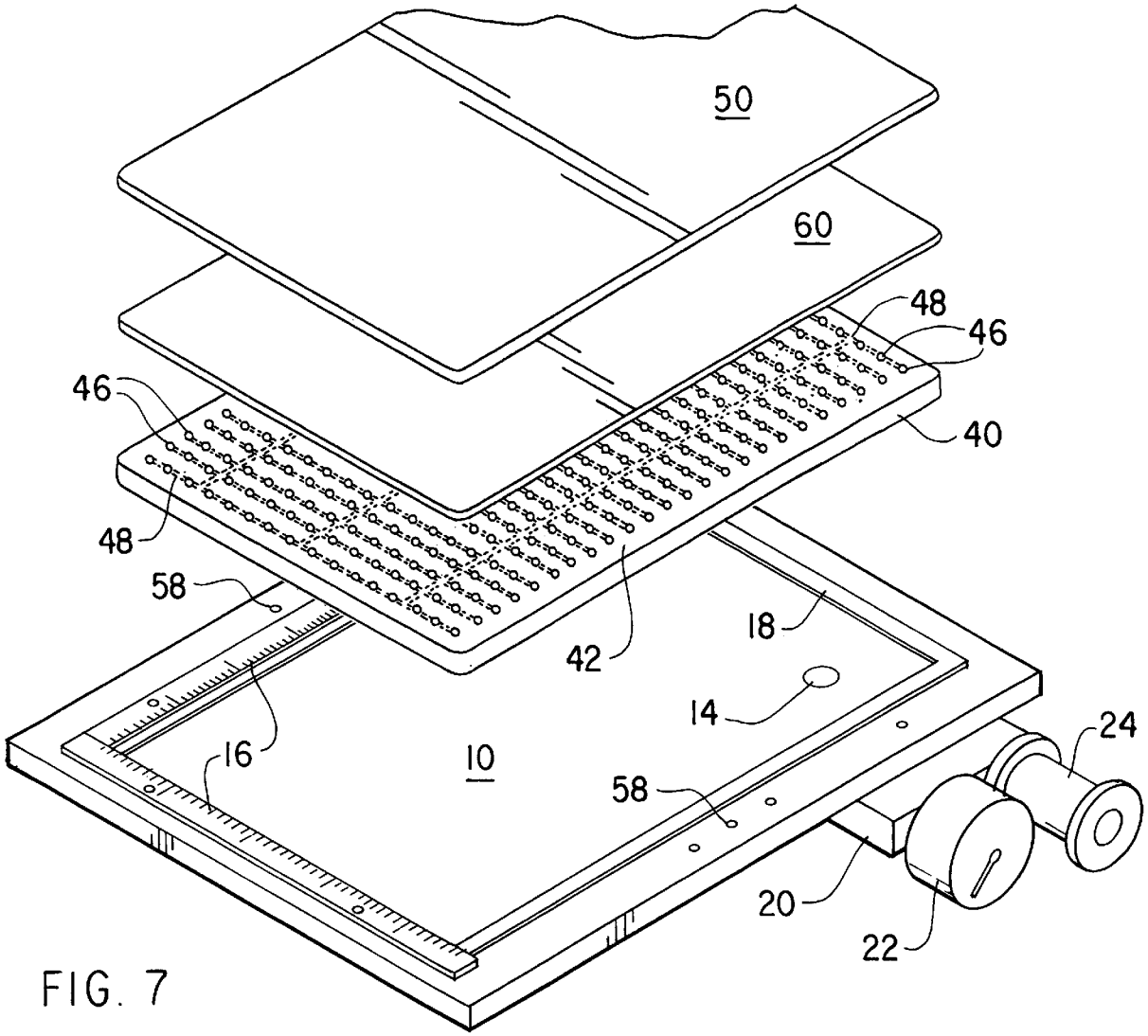
FIG. 7 is a perspective view of a third embodiment of a vacuum table and mat according to the present invention.
Figure 8:
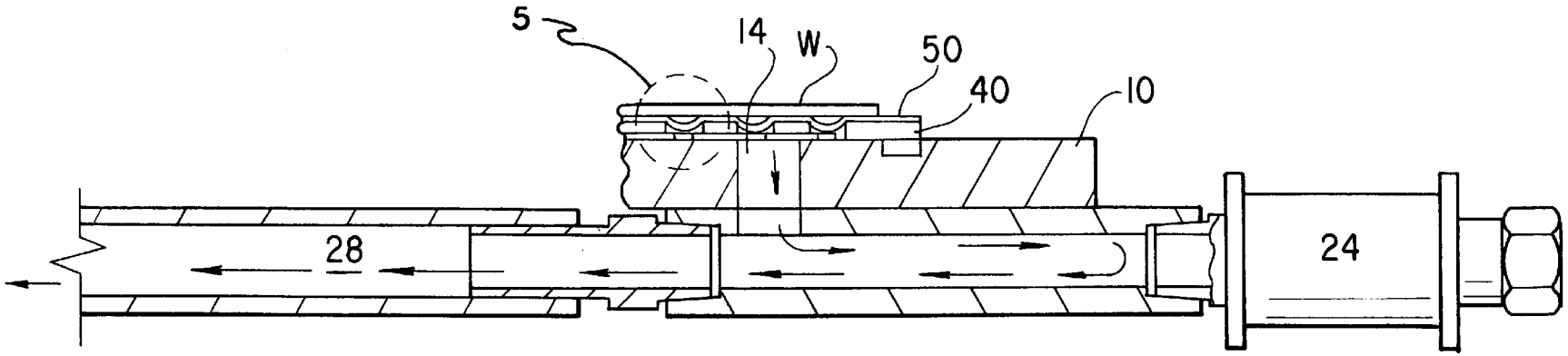
FIG. 8 a side, partially sectional view of a third embodiment of the vacuum system according to the present invention, illustrating airflow in the on position.
Figure 9:
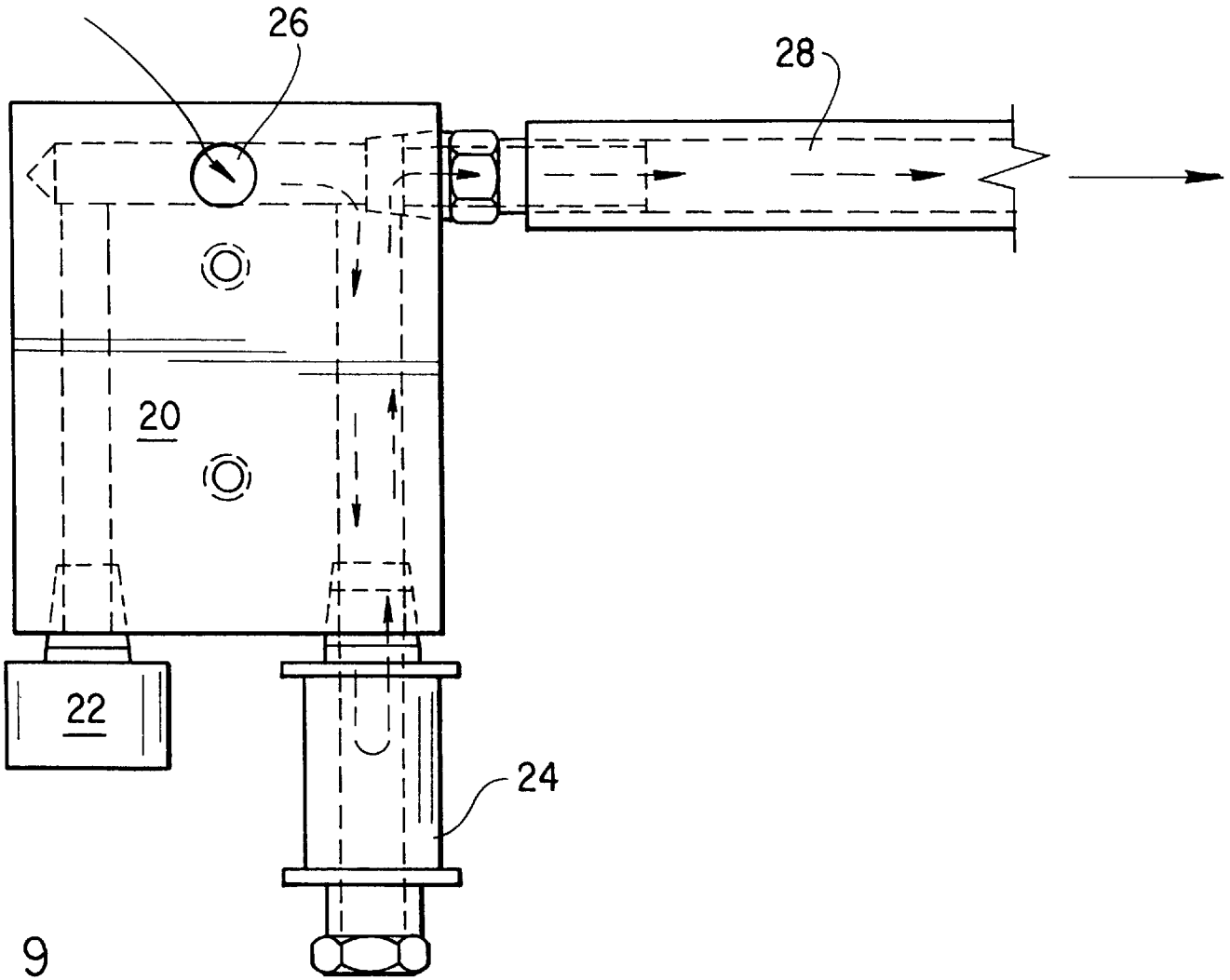
FIG. 9 is a top view of a vacuum manifold used in the third embodiment of the vacuum system according to the present invention, illustrating airflow in the on position.
Figure 10:
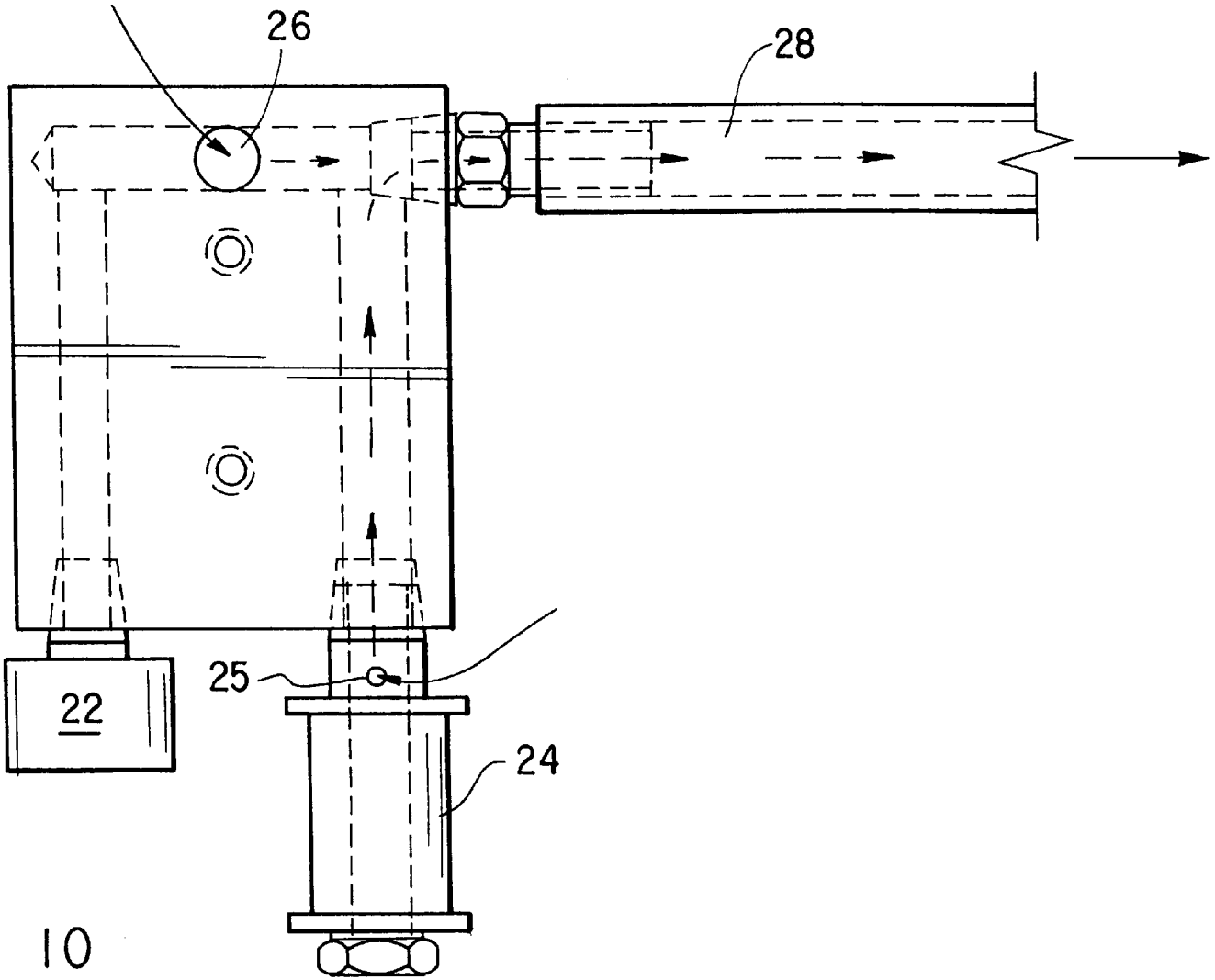
FIG. 10 is a top view of a vacuum manifold used in the third embodiment of the vacuum system according to the present invention, illustrating airflow in the off position.
Figure 11:
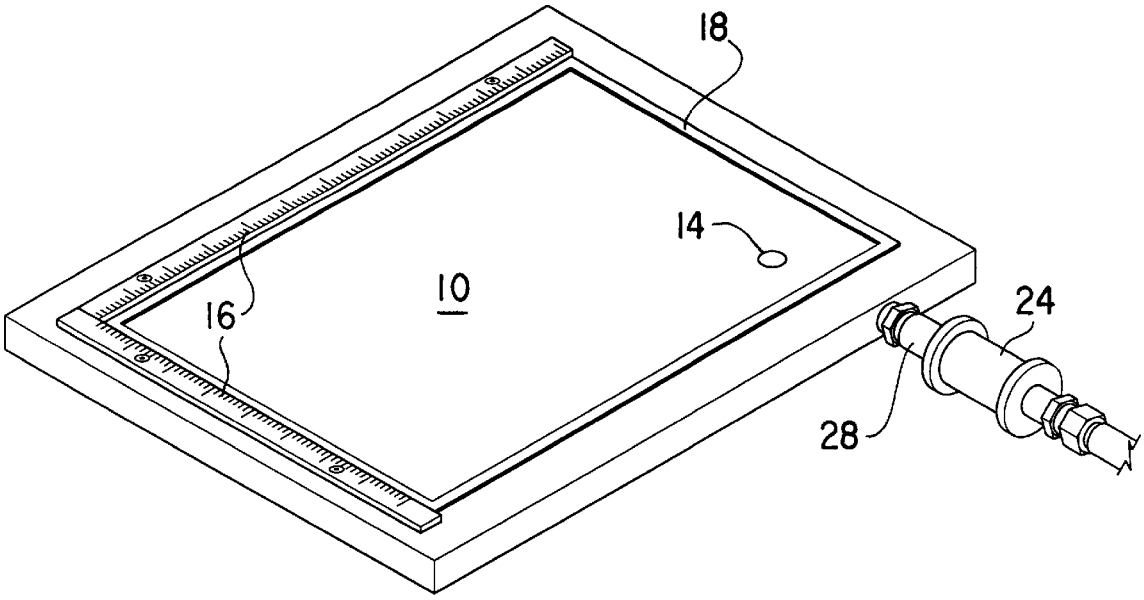
FIG. 11 is a top perspective view of a second embodiment of the vacuum table according to the present invention.

Referring to FIGS. 1, 7, and 11, the vacuum plate 10 forms a base for the table 50. The mat 52 has been omitted from FIG. 11 for simplicity, as this mat is identical to those appearing in FIGS. 1 and 7. In a preferred embodiment, the plate 10 is made from aluminum. The plate 10 is preferably rectangular and defines a groove 56 (FIGS. 2–3) about its perimeter. An aperture 14 (FIGS. 4, 10), ultimately used to pull air to the vacuum pump, is defined by the plate 10. A pair of graduate rules 16 preferably bound the plate 10 at its uppermost and leftmost sides permit measurement of a workpiece on the table.

A gasket 18 mounts within the perimetric groove 56 of the vacuum plate 10. The gasket 18 may be secured with adhesive on its underside to the vacuum plate 10. Protruding slightly above the level of the plate, the gasket 18 may later be compressed to form an air tight seal with the mat. The protrusion of the gasket 18 above the plate will preferably be 0.020 inch.

Figure 2:
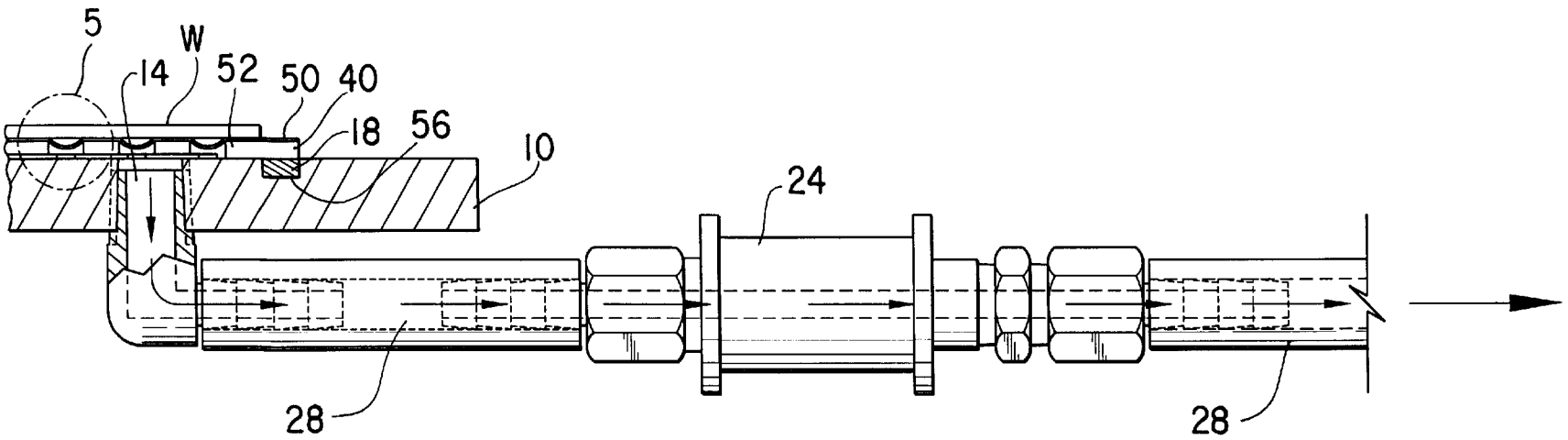
FIG. 2 is side, partially sectional view of the first embodiment of a vacuum table, illustrating air flow via the vacuum pump.

Referring to FIGS. 1, 2, and 7, the plate 10 may include a plurality of holes 58 along its edges for mating with the guide pins on the workholding vise assemblies of engraving machines having such workholders. Portions of the vacuum assembly 54, described in detail below, may attach to the bottom surface of these plates 10. Alternatively, referring to FIGS. 3 and 11, the plate 10 may be completely planar for mounting on the T-slot tables of engraving machines having these alternative workholders. The vacuum assembly 54 must attach to the end of such plates 10, with the appropriate airflow passages contained within the plates 10, as is also explained in detail below.

A replaceable mat 52 is mounted on the vacuum plate 10, engaging the gasket 18. An airtight seal is formed by the gasket 18 when vacuum is applied to the system. The mat 52 forms the work surface to which a work piece W is ultimately held by the vacuum forces. The mat 52 has two layers, a base sheet 40 and a rubber sheet 50, preferably adhered to one another by an adhesive layer 60.

The base sheet 40 is preferably formed of polyvinyl chloride (PVC) plastic. The base sheet 40 defines an upper surface 42 to which the rubber sheet 50 is affixed, and a lower surface which engages the gasket 18. A plurality of perforations 46 are defined by the base sheet 40. Each perforation is preferably one quarter of an inch in diameter, although other sizes may be used. The perforations 46 are arranged in an orderly fashion, each preferably separated by a distance of one half inch. Each perforation passes completely through the base sheet 40, from the upper surface 42 through the lower surface. A network of channels 48 interconnect each perforation. The channels 48 are defined only on the lower surface, and do not pass completely through the base sheet 40.

Figure 5:
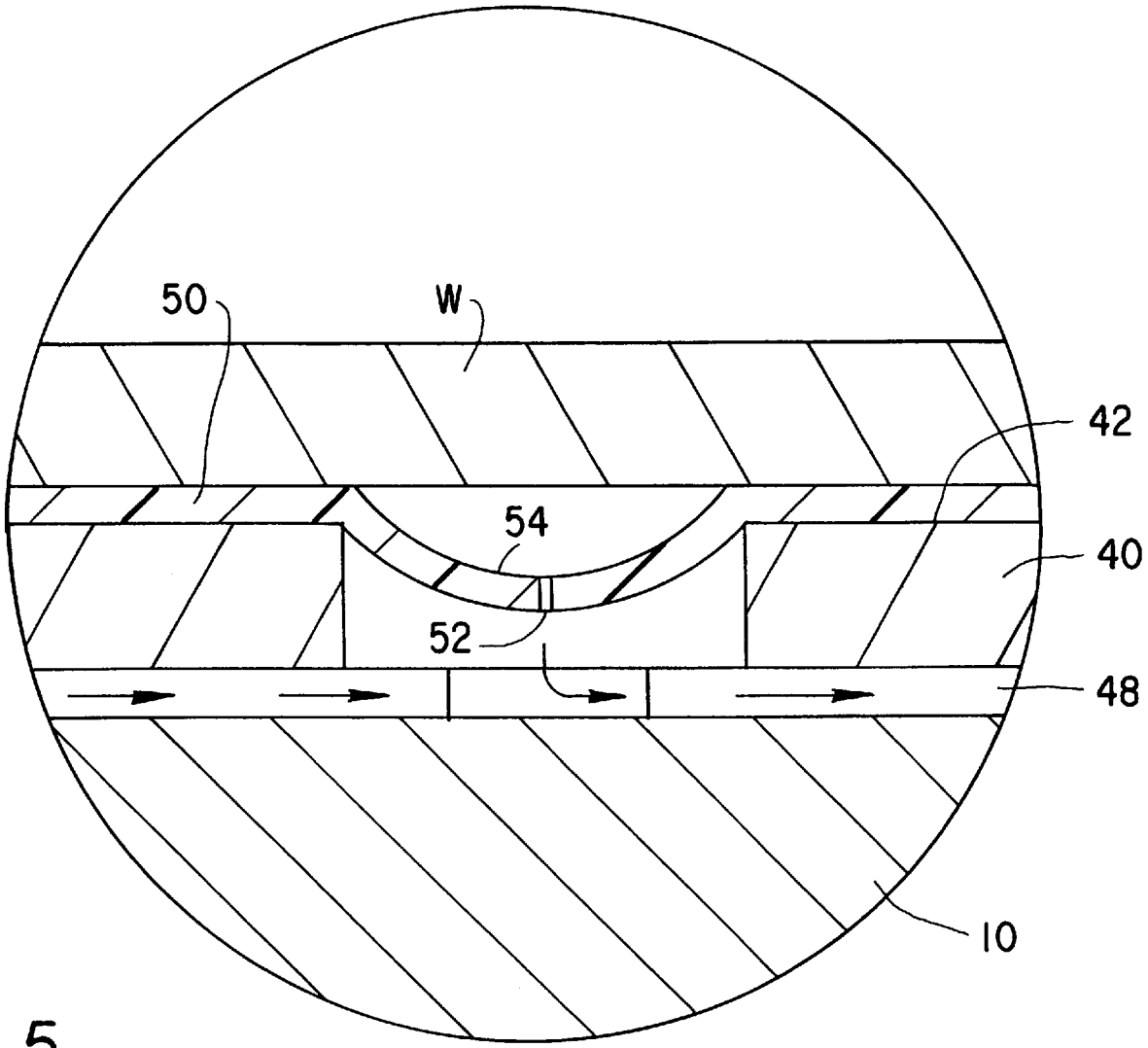
FIG. 5 is a greatly enlarged detail sectional view of the area forming the suction-cup like depression of the mat below the work piece.
Figure 6:
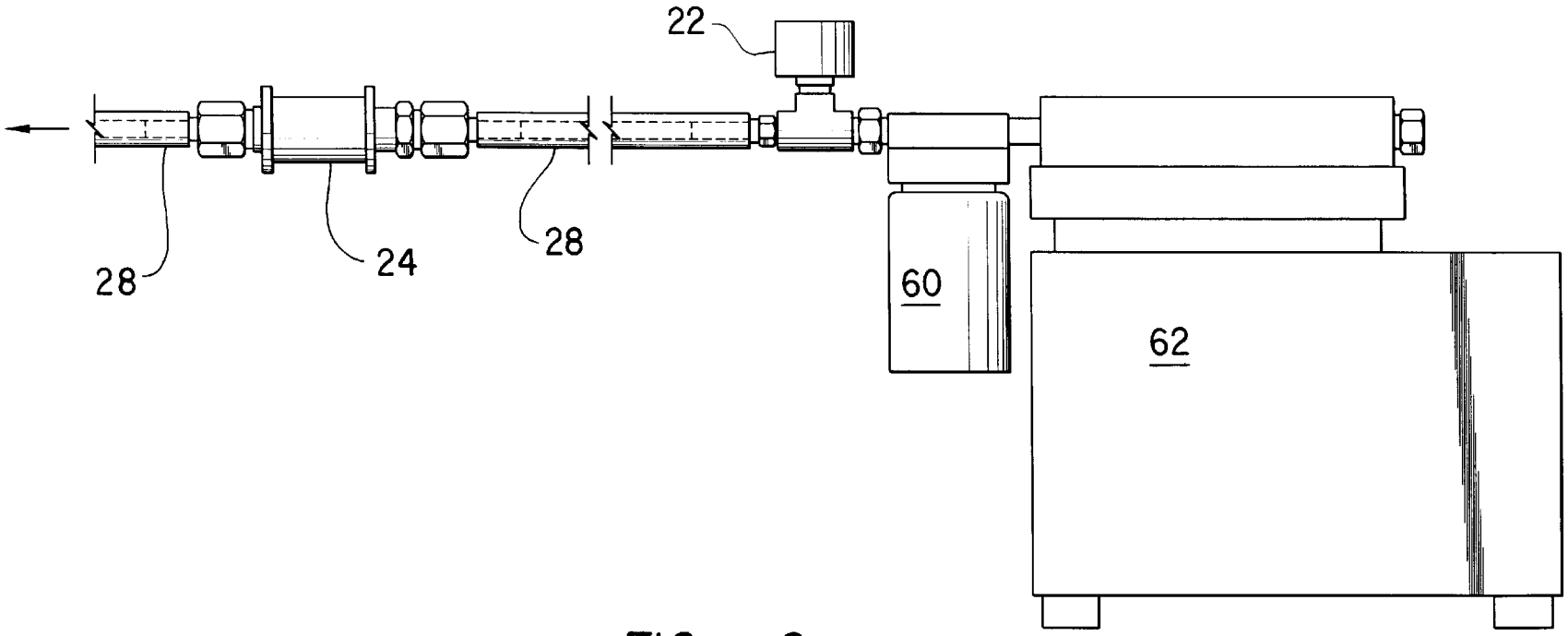
FIG. 6 is a side view of a vacuum system used with the first and second embodiments of the vacuum system according to the invention.

The resilient upper sheet 50 is affixed, with adhesive, to the upper surface of the base sheet 40. Resilient sheet 50 is preferably made from rubber. A plurality of pin holes 52, preferably 0.004 inch in diameter, are aligned with and centrally disposed above each perforation of the base sheet 40. When a vacuum is applied under the base sheet 40, portions of the rubber sheet 50 are pulled into the perforations 46, resulting in a plurality of suction-cup like indentations 54 of the rubber sheet 50. It is these suction-cup like indentations 54 which ultimately engage and hold a workpiece in place on the vacuum table, as best seen in FIG. 5.

The vacuum assembly 54 preferably is one of the three embodiments described below. The first vacuum assembly 54, for a workholding vise assembly, is illustrated in FIGS. 1, 2, 4, and 6. The aperture 14, passing completely through plate 10, connects to hose 28, preferably by pipe-tapping aperture 14. Hose 28 includes a slide valve regulator 24, which is preferably configured as a tube encircling the hose 28. The slide valve regulator 24 reciprocates between a closed position wherein it covers an aperture 25 in hose 28, and an open position wherein it exposes the aperture 25. When the aperture 25 is covered, all air flow into hose 28 must be from aperture 14, maximizing suction at plate 10, whereas opening aperture 25 allows air to enter hose 28 through aperture 25, reducing suction at plate 10.

Hose 28 connects at its opposite end to a pressure gauge 22, air filter 60, and finally to vacuum pump 62. The vacuum pump 62 supplies vacuum pressure to the system, which can be measured by the pressure gauge 22.

The second embodiment of the vacuum apparatus 54, for use with T-slot workholders, is illustrated in FIGS. 3, 4, 6, and 11. The aperture 14 passes only partially through plate 10, and connects with pipe-tapped air passage 64. The pipe-tapped air passage 64 connects to hose 28. Hose 28 includes a slide valve regulator 24, reciprocating between a closed position wherein it covers an aperture 25 in hose 28, and an open position wherein it exposes the aperture 25. When the aperture 25 is covered, all air flow into hose 28 must be from aperture 14, maximizing suction at plate 10, whereas opening aperture 25 allows air to enter hose 28 through aperture 25, reducing suction at plate 10.

Hose 28 connects at its opposite end to a pressure gauge 22, air filter 60, and finally to vacuum pump 62. The vacuum pump 62 supplies vacuum pressure to the system, which can be measured by the pressure gauge 22.

The third embodiment of the vacuum apparatus 54 includes a manifold block 20 mounted under the vacuum plate 10. The manifold block 20 includes a vacuum gauge 22 for measuring the amount of vacuum pressure being applied by the system and a slide valve regulator 24 which are in fluid communication via conduits and hoses with the vacuum plate 10 and the vacuum pump. The manifold is connected at one end via a conduit 26 to the aperture 14 in the vacuum plate 10 and at another end via hoses 28 to the vacuum pump (not shown). The slide valve regulator 24 works to control the vacuum applied to the vacuum plate 10. The slide valve selects between closing the system (creating a vacuum) and opening the system (releasing the vacuum). To close the system, the slide valve covers an opening 25 in the manifold block 20 forcing air to be evacuated from the vacuum plate 10. In contrast, the opening 25 is exposed, causing the pump to pull from the path of least resistance, which leads to the open atmosphere, and the vacuum within the table is broken.

Figure 3:
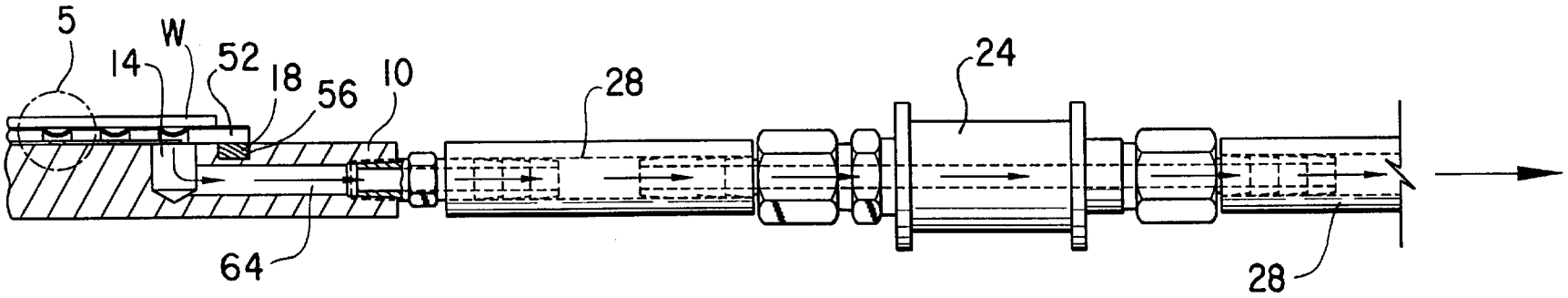
FIG. 3 is a side, partially sectional view of a second embodiment of the vacuum system according to the invention, illustrating airflow in the on position.
Figure 4:
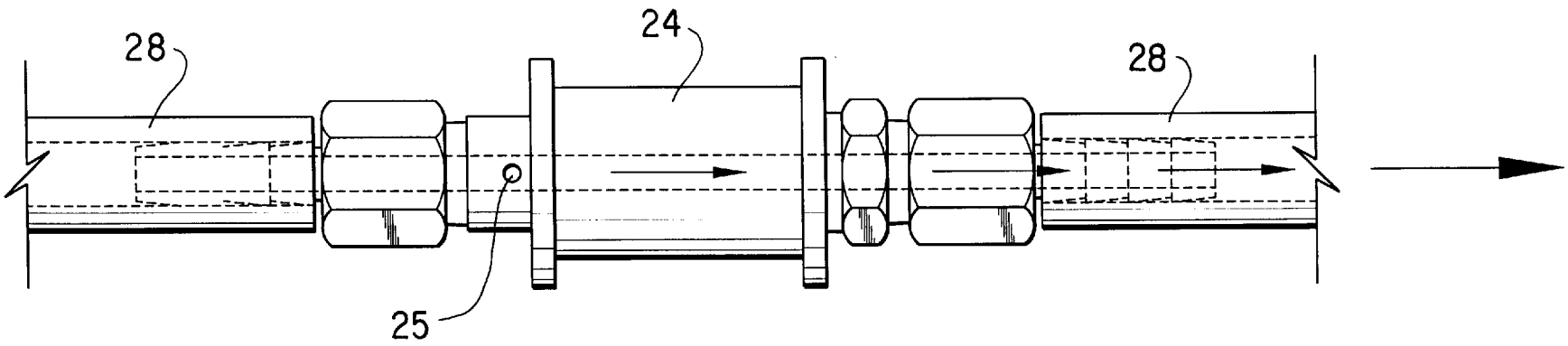
FIG. 4 is a top perspective view of a slide valve regulator used with all three embodiments of the vacuum system according to the invention, illustrating air flow in the off position.

In operation, a workpiece is place on the rubber sheet 50 of the mat, which is in place over the vacuum plate 10. The vacuum pump is started, pulling air from the system. If the slide valve is open as seen in FIG. 4, air is pulled from the atmosphere, and no vacuum is created within the table. Once the slide valve is closed, as seen in FIG. 3, the pump pulls air from within the table.

Ultimately, the internal vacuum pulls on the rubber sheet 50 through the perforations 46 in the base sheet 40 of the mat. The rubber sheet 50 is pulled partially into each perforation. The pulling of the rubber sheet 50 creates a small space between the rubber sheet 50 and the workpiece. The space also creates a vacuum which holds the workpiece in place, much like a suction-cup. The pin holes 52 in the rubber sheet 50 correspond to the center of each suction-cup like indentation thus formed. The work piece actually seals the cups allowing air to be drawn downward into the system, creating a plurality of miniature vacuum chambers. Because the pin holes 52 are relatively tiny, the rubber sheet 50 is still pulled into the perforation of the base sheet 40, but an additional amount of air is evacuated from the cavity formed between the rubber and the workpiece causing the workpiece to be held firmly in place until the system is opened via the slide valve.

Because the mat is replaceable and constructed of relatively inexpensive materials, it may be discarded if it becomes damaged. Only the mat need be replaced, not the entire vacuum table. This design also obviates the need to send the table out for repairs in the event the surface becomes marred. A simple replacement of the mat readies the system for extended use.

Although the mat and vacuum table may be made in many different shapes and sizes, the preferred form is a rectangular table having a mat of any of the following dimensions: 3.5 by 9 inches, 8.25 by 12.25 inches, and 19.75 by 25.25 inches. The vacuum table is especially well suited for holding items for engraving applications, but may be used for other purposes.

It is to be understood that the present invention is not limited to the sole embodiments described above, but encompasses any and all embodiments within the scope of the following claims.

I claim:

1. A vacuum table comprising:

a vacuum plate having a plurality of edges, said vacuum plate defining a perimetric groove and defining an aperture;

a gasket affixed to said vacuum plate within said perimetric groove such that said gasket protrudes above said plate;

a replaceable mat mounted on said gasket, said mat comprising:

a base sheet having an upper and a lower surface, and defining a plurality of perforations passing completely through said upper and lower surfaces of said base sheet, said base sheet further defining network of channels, formed in the lower surface, interconnecting said perforations; and a resilient upper sheet affixed to said upper surface of said base sheet, said upper sheet defining a plurality of pinholes, each corresponding to and in central registry with one of said perforations of said base sheet; and a vacuum apparatus for creating a vacuum;

whereby evacuation of air from the perforations of the base sheet through said network of channels of said base sheet to the vacuum apparatus causes said resilient sheet to be pulled into said perforations of said base sheet thereby forming a plurality of suction-cup-like structures for engaging and holding a work surface.

2. The vacuum table as recited in claim 1 wherein said vacuum plate is constructed of aluminum.

3. The vacuum table as recited in claim 1 wherein said base sheet is plastic.

4. The vacuum table as recited in claim 1, wherein said base sheet is made from polyvinyl chloride.

5. The vacuum table as recited in claim 1, wherein said plurality of perforations in said base member are each approximately one quarter inch in diameter and each separated by a distance of approximately one half inch.

6. The vacuum table according to claim 1, wherein said resilient upper member is made from rubber.

7. The vacuum table as recited in claim 1, wherein said pin holes are approximately 0.004 inch in diameter.

8. The vacuum table as recited in claim 1, wherein said gasket protrudes above said vacuum plate by approximately 0.020 inch.

9. The vacuum table according to claim 1, further comprising a plurality of holes defined along said edge of said vacuum plate, said holes being dimensioned and configured to receive a guide pin of a workholding vise assembly.

10. The vacuum table according to claim 1, wherein said vacuum apparatus comprises:

a vacuum pump; and a hose connected between said vacuum pump and said vacuum plate's aperture.

11. The vacuum table according to claim 10, wherein said vacuum apparatus further comprises a pressure gauge.

12. The vacuum table according to claim 10, wherein said vacuum apparatus further comprises:

an aperture defined within said hose; and a slide valve regulator, said slide valve regulator reciprocating between a closed position wherein it covers said aperture defined within said hose, and an open position wherein it exposes said aperture defined within said hose.

13. The vacuum table according to claim 12, wherein said slide valve regulator is configured as a tube encircling said hose.

14. The vacuum table according to claim 10, wherein said aperture defined within said vacuum plate passes completely through said vacuum plate.

15. The vacuum table according to claim 14, wherein said aperture defined within said vacuum plate is pipe tapped.

16. The vacuum table according to claim 14, further comprising a manifold connected between said hose and said aperture defined within said vacuum plate.

17. The vacuum table according to claim 16, wherein said manifold block includes a pressure gauge.

18. The vacuum table according to claim 10:

wherein said aperture defined within said vacuum table passes only partially through said plate; and further comprising an air passage connected between said aperture defined within said vacuum table and said hose.

19. The vacuum table according to claim 18, wherein said air passage is pipe tapped.

* * * * *